US005595502A

United States Patent [19]

Allison

[11] Patent Number: 5,595,502

[45] Date of Patent: Jan. 21, 1997

[54] CONNECTOR FOR COAXIAL CABLE HAVING HOLLOW INNER CONDUCTOR AND METHOD OF ATTACHMENT

[75] Inventor: Lee F. Allison, Mokena, Ill.

[73] Assignee: Andrew Corporation, Orland Park, Ill.

[21] Appl. No.: 511,473

[22] Filed: Aug. 4, 1995

[51] Int. Cl.[6] ..... H01R 4/26

[52] U.S. Cl. ..... 439/429; 439/583; 29/857

[58] Field of Search ..... 439/578, 583–4, 439/805, 518, 277, 429; 411/411, 412, 394; 29/857

[56] References Cited

U.S. PATENT DOCUMENTS 1,545,566 7/1925 Lutze ..... 439/805
5,322,454 6/1994 Thommen ..... 439/584
5,354,217 10/1994 Gabel et al. ..... 439/584

*Primary Examiner*—Neil Abrams
*Assistant Examiner*—Brian J. Biggi
*Attorney, Agent, or Firm*—Arnold, White & Durkee

[57] ABSTRACT

In accordance with the present invention, the foregoing objectives are realized by providing a connector assembly comprising an outer connector for engaging the outer conductor of the cable, an inner connector having a threaded portion adapted to fit into the hollow inner conductor in threaded engagement with the interior surface of the inner conductor, the threads comprising a plurality of interleaved concentric threads, and a dielectric spacer between the inner and outer connectors. In a preferred embodiment, the multiple interleaved threads are self-tapping threads so that the inner connector can be simply threaded into the hollow inner conductor without any advance tapping of the inner conductor.

24 Claims, 4 Drawing Sheets

CONNECTOR FOR COAXIAL CABLE HAVING HOLLOW INNER CONDUCTOR AND METHOD OF ATTACHMENT

FIELD OF THE INVENTION

The present invention relates generally to connectors for coaxial cables, and, more particularly, to an improved connector for coaxial cables having hollow inner conductors. The invention also relates to methods of attaching such connectors and cables, and to the resulting assemblies.

BACKGROUND OF THE INVENTION

Connectors for coaxial cables having hollow inner conductors have been used throughout the semi-flexible coaxial cable industry for a number of years. For example, Rauwolf U.S. Pat. No. 5,167,533 describes a connector for coaxial cables having hollow inner conductors. Vaccaro et at. U.S. Pat. No. 5,154,636 describes a connector for coaxial cables having helically corrugated outer conductors. Doles U.S. Pat. No. 5,137,470 describes a connector for coaxial cables having hollow and helically corrugated inner conductors. Juds et at. U.S. Pat. No. 4,046,451 describes a connector for coaxial cables having annularly corrugated outer conductors and plain cylindrical inner conductors. Van Dyke U.S. Pat. No. 3,291,895 describes a connector for cables having helically corrugated outer conductors and hollow, helically corrugated inner conductors. A connector for a coaxial cable having a helically corrugated outer conductor and a hollow, plain cylindrical inner conductor is described in Johnson et al. U.S. Pat. No. 3,199,061.

The Johnson et at. patent describes a self-tapping connector for the inner conductor of the coaxial cable. Such connectors are time-consuming to install and expensive to manufacture. Also, when the inner connector is made of brass, overtightening causes the threads to strip off the connector rather than the end portion of the inner conductor of the cable, and thus the connector must be replaced.

SUMMARY OF THE INVENTION

It is a primary object of the invention is to provide an improved coaxial cable connector having a self-tapping inner connector which can be installed easily and quickly. A related object is to provide such an improved connector that is self-locating as it is applied to the end of a coaxial cable, and which can be easily installed by hand.

It is another object of the invention to provide such an improved connector which can be efficiently and economically manufactured at a relatively low cost.

A further object of this invention is to provide an improved connector in which overtightening results in stripping of the threads in the cable rather than the connector.

Still another object of this invention is to provide an improved method of attaching a connector to a coaxial cable having a hollow inner conductor, so that good electrical contact is maintained between the connector and the cable over a long operating life.

Other objects and advantages of the invention will be apparent from the following detailed description and the accompanying drawings.

In accordance with the present invention, the foregoing objectives are realized by providing a connector assembly comprising an outer connector for engaging the outer conductor of the cable, an inner connector having a threaded portion adapted to fit into the hollow inner conductor in threaded engagement with the interior surface of the inner conductor, the threads comprising a plurality of interleaved concentric threads, and a dielectric spacer between the inner and outer connectors. In a preferred embodiment, the multiple interleaved threads are self-tapping threads so that the inner connector can be simply threaded into the hollow inner conductor without any advance tapping of the inner conductor.

The inner connector is preferably made of a relatively hard conductive alloy, such as a copper-zinc alloy (e.g., UNS-C67400) or a beryllium-copper alloy (e.g., UNS-C17300). The use of such materials facilitates the self-tapping operation, and also protects the connector in the event of overtightening because the threads will strip on the conductor before they strip on the connector. Thus the connector can be re-installed, after cutting off a short length of the end of the conductor.

DETAILED DESCRIPTION OF THE PREFERRED EMBODIMENT

Figure 1:
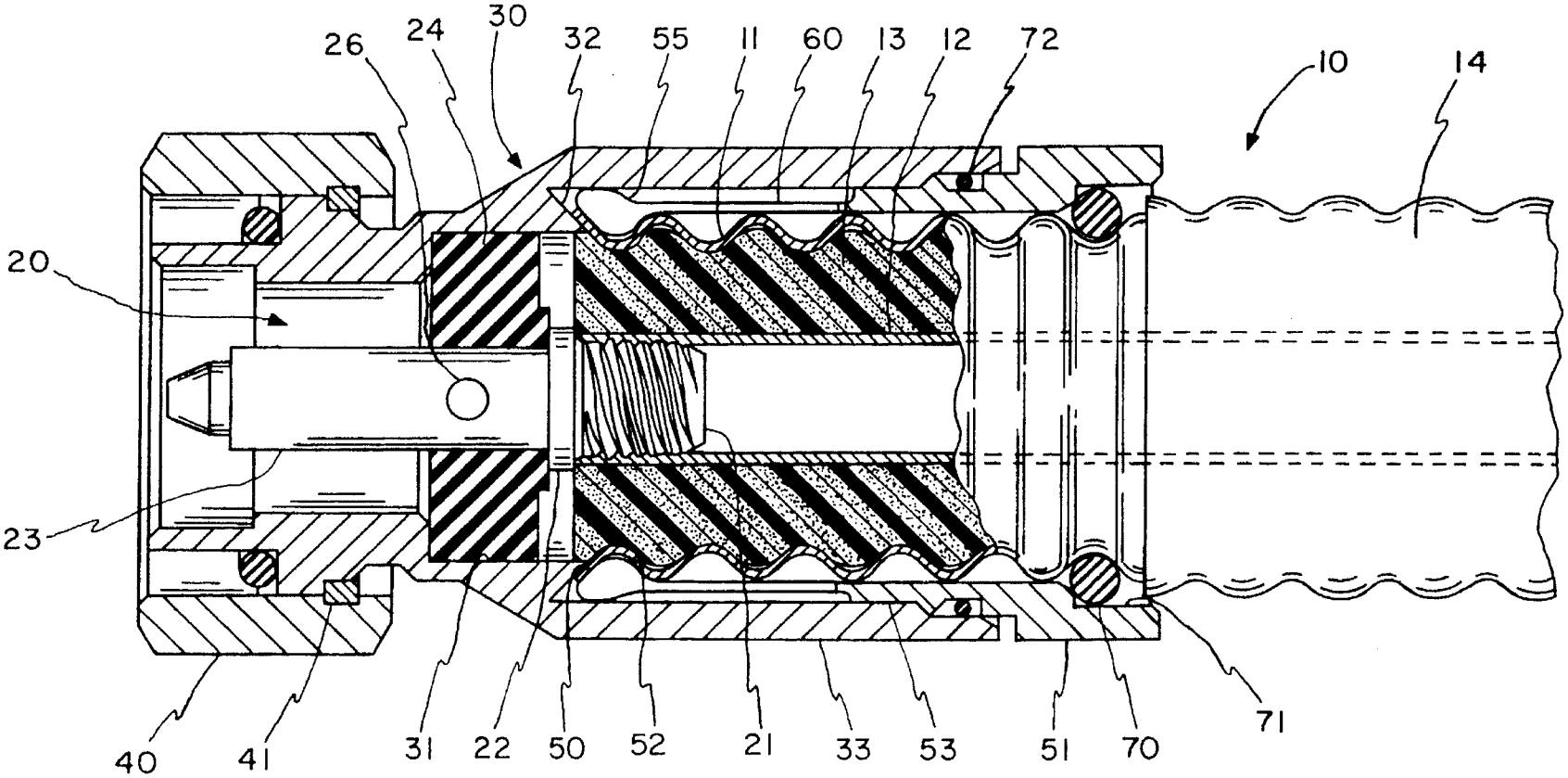
FIG. 1 is a side elevation, partially in section, of a connector embodying the present invention, and a coaxial cable for receiving the connector.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

Turning now to the drawings, there is shown a connector assembly for a coaxial cable 10 having an annularly corrugated outer conductor 11 concentrically spaced from a hollow inner conductor 12 by a foam dielectric 13. As is well known to those familiar with this art, an "annularly" corrugated conductor is distinguished from a "helically" corrugated conductor in that the annular corrugations form a series of spaced parallel crests which are discontinuous along the length of the cable, and, similarly, a series of spaced parallel valleys which are also discontinuous along the length of the cable. That is, each crest and valley extends around the circumference of the conductor only once, until it meets itself, and does not continue in the longitudinal direction. Consequently, any transverse cross-section taken through the conductor perpendicular to its axis is radially symmetrical, which is not true of helically corrugated conductors.

To prepare the cable 10 for attachment of the connector assembly, the end of the cable is cut along a plane extending through the apex of one of the crests of the corrugated outer conductor and perpendicular to the axis of the cable. This exposes the clean and somewhat flared internal surface of the outer conductor 11. The foam dielectric 13 normally does not fill the crests of the corrugated outer conductor 11, so a small area of the inner surface of the outer conductor is exposed adjacent the cut end of this conductor at the apex of the crest through which the cut is made; however, if the foam dielectric does fill the entire crest, then a portion of the dielectric should be removed to permit contact with the inner surface of the outer conductor 11 adjacent the cut end thereof. Any burrs or rough edges on the cut ends of the metal conductors are preferably removed to avoid interference with the connector. The outer surface of the outer conductor 11 is normally covered with a plastic jacket 14 which is trimmed away from the end of the outer conductor 11 along a sufficient length to accommodate the connector assembly.

Electrical contact with the inner conductor 12 of the cable 10 is effected by an inner connector element 20 having a threaded anchoring member 21 which is self-tapping as it is threaded into the hollow conductor 12, an enlarged collar 22 which engages the end of the inner conductor, an elongated pin 23 for connecting the inner conductor to a conventional complementary female member (not shown), and an insulator 24 for centering the pin 23 within the main body member 30 of the connector assembly while electrically isolating these two elements form each other. It will be noted that the interior of the body member 30 includes a recess 31 for receiving the insulator 24, which is also conventional in the art of coaxial cable connectors.

A coupling nut 40 secured to the body member 30 around the pin 23 is a conventional fitting, and is secured to the body member by a spring retaining ring 41 which holds the nut 40 captive on the member 30 while permitting free rotation of the nut 40 on the member 30. As will be apparent from the ensuing description, this coupling nut 40 serves as a part of the electrical connection to the outer conductor of the cable 10, and is insulated from the inner conductor by the insulator 24 carried by the inner connector pin 23.

The body member 30 includes a conically beveled clamping surface 32 which engages the inner surface of the outer conductor 11. This clamping surface 32 is formed as an integral part of the interior surface of the body member 30, and is continuous around the entire circumference of the cable to ensure good electrical contact with the inner surface of the outer conductor 11. Cooperating with the clamping surface 32 is a second clamping surface 50 formed on one end of an annular clamping member 51 for engaging the outer surface of the outer conductor 11. More specifically, this outer clamping surface 50 is formed on one side of an inner bead 52 which projects from the inside surface of the clamping member 51 into the last valley of the corrugated outer conductor 11 adjacent the end of the cable so as to lock the clamping member 51 to the cable 10 in the axial direction.

For the purpose of drawing the two clamping surfaces 32 and 50 firmly against opposite sides of the flared end portion of the outer conductor 11, the two members 30 and 51 include respective telescoping sleeve portions 33 and 53 with cooperating threaded surfaces. Thus, when the two members 30 and 51 are rotated relative to each other in a first direction, they are advanced toward each other in the axial direction so as to draw the clamping surfaces 32 and 50 into electrically conductive engagement with the outer conductor 11. When the annular flared end portion of the outer conductor 11 is clamped between the two surfaces 32 and 51, it is also flattened to conform to the planar configuration of the clamping surfaces 32 and 50. To detach the connector assembly from the outer conductor 11, the two members 30 and 51 are simply rotated relative to each other in the opposite direction to retract the two members away from each other until the threaded surfaces are disengaged to permit the bead to pass over the crest of the corrugated outer conductor as the clamping member is advanced longitudinally over the end of the cable.

A plurality of longitudinal slits 60 are formed in the beaded end of the clamping member 51, extending through the bead 52 and into a substantial length of the sleeve portion 53. The slits 60 thus form a plurality of resilient segments which act like spring fingers when a radial force is applied thereto. Consequently, when the sleeve portion 53 of the member 51 is slipped over the cable 10 with the bead 52 engaging the cut edge of the outer conductor 11, continued application of pressure to the member 51 causes the resilient segments to be deflected radially outwardly until the bead 52 clears the crest at the end of the corrugated outer conductor 11. The bead 52 then slides over the crest of the outer conductor 11 and snaps into the last corrugation valley, as illustrated in FIG. 1, thereby locking the clamping member 51 to the cable 10 in the axial direction.

For the purpose of avoiding rotation of the clamping member 51 around the cable 10 while the body member 30 is threaded thereover, a raised bead 55 projects from the outer surface of the member 51. As can be seen in FIG. 1, this bead 55 minimizes the area of frictional engagement between the two members 30 and 51, and spaces the unthreaded portions of the opposed surfaces of these two members away from each other. After the two members 30 and 51 are threaded together, the engagement of the inner surface of the body member 30 with the outer bead 55 maintains the locking action of the inner bead 52 by preventing any outward deflection of the resilient segments as long as the two member 30 and 51 remain connected.

To provide a moisture barrier between the inner surface of the clamping member 51 and the outer surface of the cable conductor 11, an O-ring 70 is positioned in a valley on the exposed portion of the outer conductor 11 before the clamping member 51 is applied thereto. Then when the clamping member 51 is installed on the cable, it slightly compresses the rubber O-ring 70 so that the O-ring bears firmly against both the outer surface of the conductor 11 and the inner surface of the clamping member 51. The adjacent end portion of the clamping member 51 forms a slightly enlarged recess 71 so that it can fit over the end of the plastic jacket 14 on the coaxial cable. A moisture barrier similar to that provided by the resilient O-ring 70 is provided by a second O-ring 72 positioned between the opposed surfaces of the sleeve portions 33 and 53 of the members 30 and 51, respectively.

Returning now to the inner connector 20 which makes electrical contact with the inner conductor 12, the threaded anchoring member 21 is self-tapping so that the connector 20 can be installed by simply turning it into the hollow inner conductor 12 until the shoulder 25 formed by the collar 22 engages the cut end of the inner conductor. A diametral hole 26 is formed in the body portion of the connector 20 for receiving a tommy bar wrench for turning the connector 20 into the conductor 12.

Figure 4:
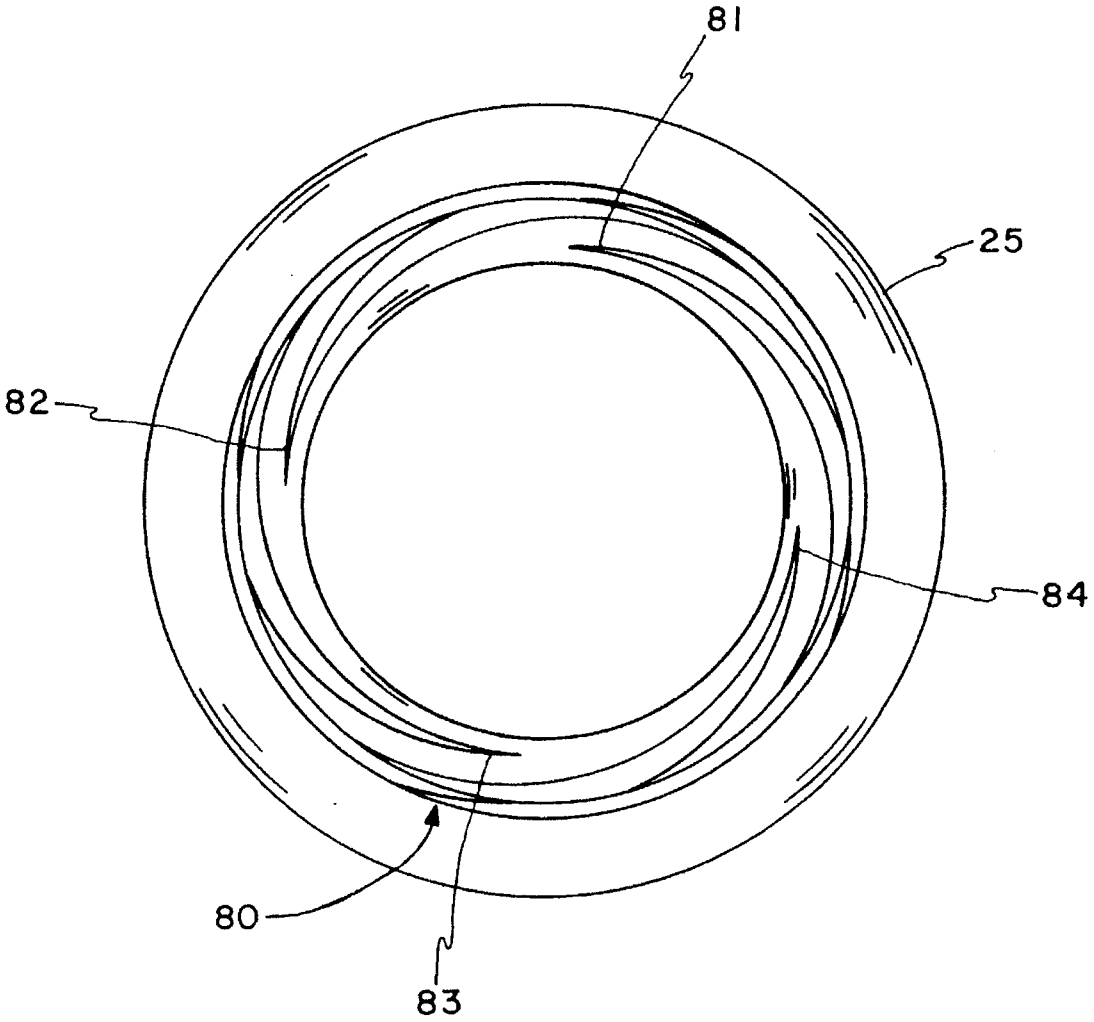
FIG. 4 is an end elevation of the connector shown in FIG. 3.

The threaded portion 80 of the anchoring member 21 includes four interleaved, concentric threads 81, 82, 83 and 84 which are equally spaced from each other along the length of the connector. Each of the four threads 81–84 has the same lead, but, as can be seen in FIG. 4, the ends of the four threads are spaced 90 degrees from each other. Thus, the ends of the four threads are symmetrically spaced from each other around the axis of the connector assembly.

Figure 2:
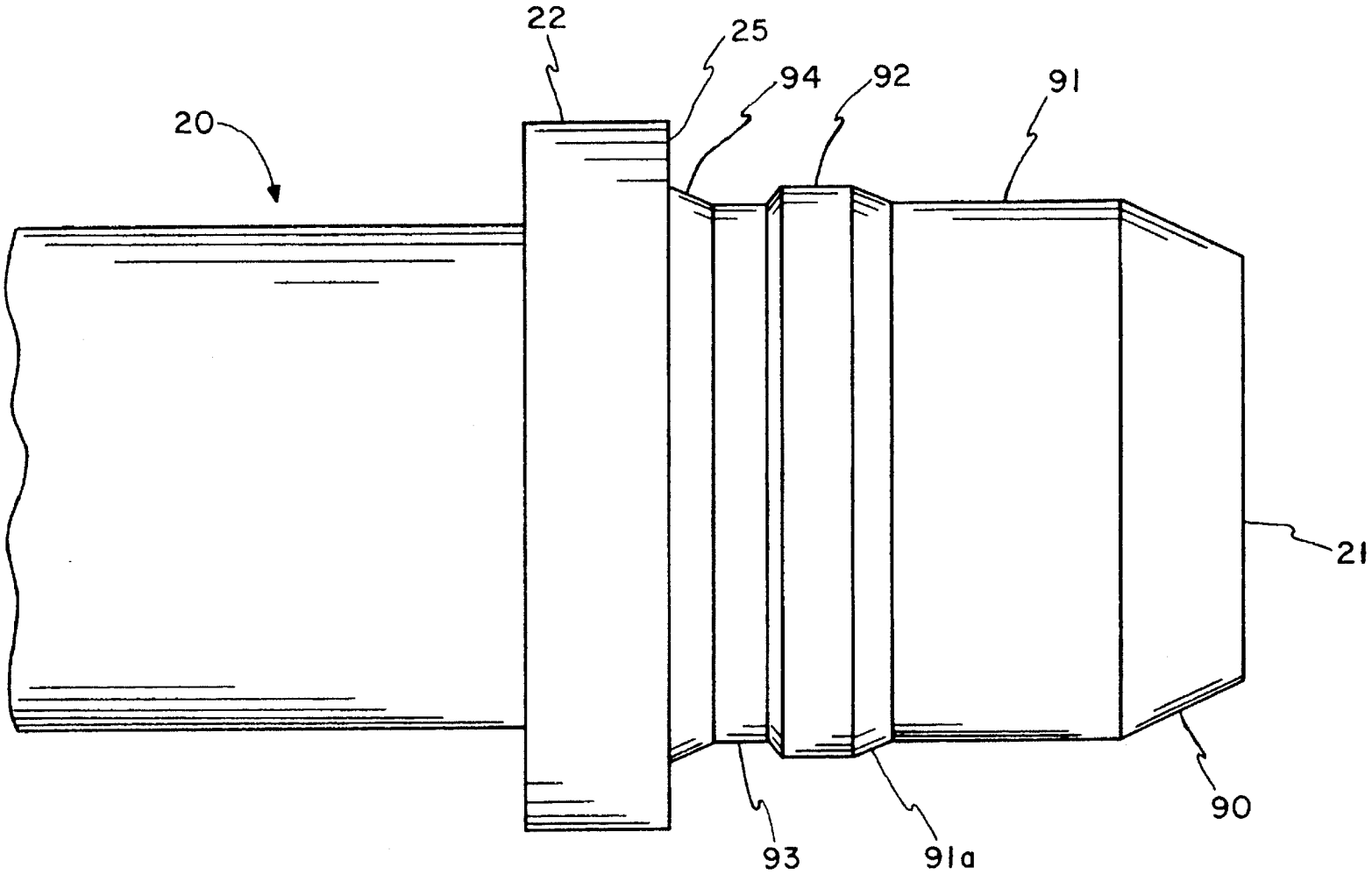
FIG. 2 is an enlarged side elevation of the end portion of a metal rod that has been machined to form the connector of FIG. 1, prior to the forming of the threads on the connector.

As can be seen most clearly from FIG. 2, which is a side elevation of the inner connector 20 before it has been threaded, the anchoring member 21 includes a tapered distal end 90, a recessed region 91, a raised region 92, and a second recessed region 93. When the connector 20 is threaded, the threading tool is maintained at a constant distance from the axis of the connector, so that the distance between the axis of the connector and the troughs of the threads 81–84 remains constant throughout the entire threaded portion 21. The taper of the threading tool and the thread dimensions are selected so that the cross-sectional profile of the threads in the raised region 92 has an inverted V shape, i.e., the crest of each thread forms an inverted V so that there is essentially no flat surface along the thread crest (in a preferred embodiment the crest of the thread forms a flat surface that is only 0.003 inch wide). It is this region 92 of the threads that are self-tapping, and the sharp V profile of the crests of the threads in this region assist in cutting into the inner wall of the hollow inner conductor 12. The crests of the threads in the region 92 lie in a cylindrical plane that has the same diameter as the region 92 in the unthreaded part shown in FIG. 2. This diameter is slightly larger than the inside diameter of the hollow conductor 12 so that the threads penetrate into the metal of the inside wall of the conductor. The depth of penetration of these threads into the inside wall of the inner conductor 12 is preferably at least 0.005 inch.

Figure 3:
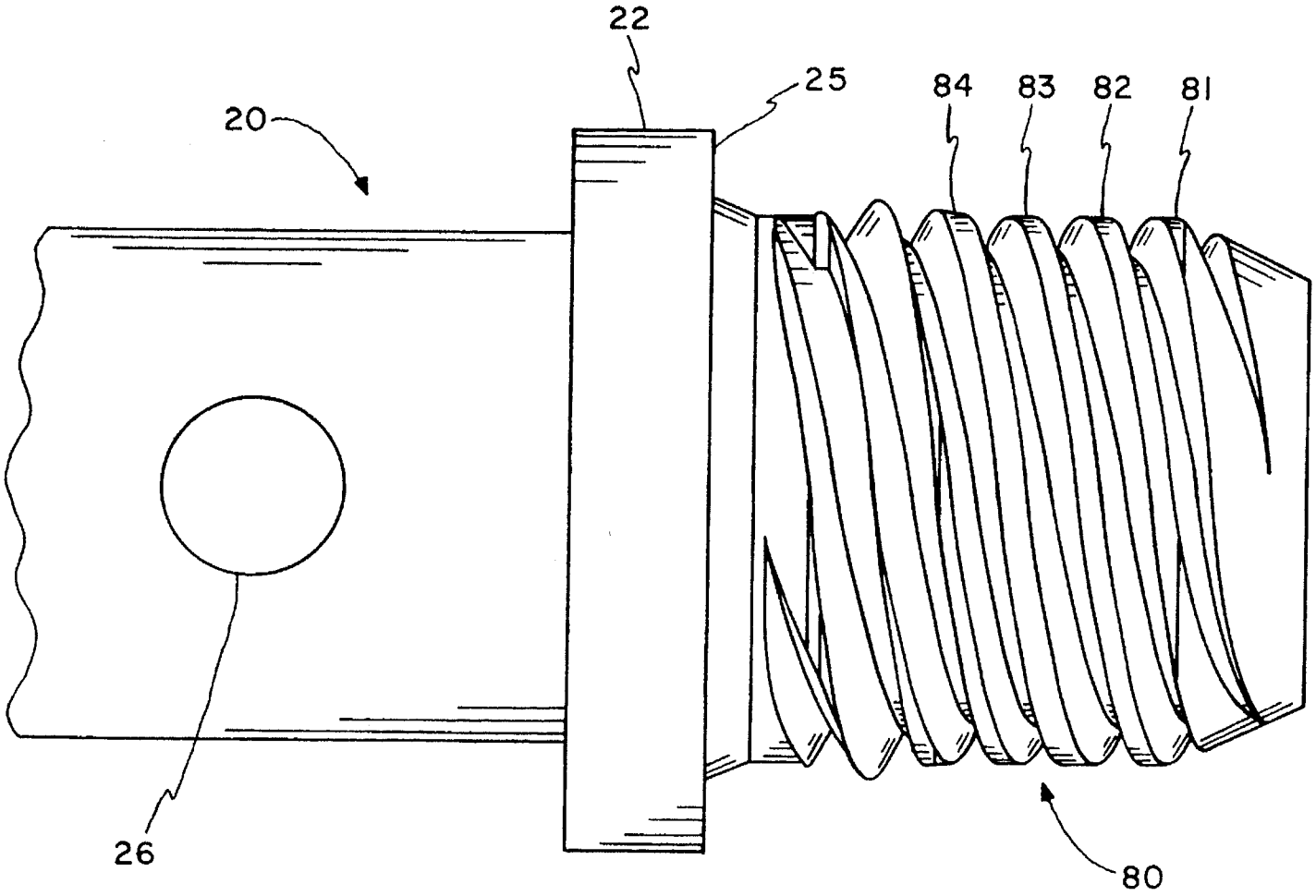
FIG. 3 is an enlarged side elevation of the metal rod shown in FIG. 2, after the forming of the threads.

When the inner connector 20 is inserted into the hollow inner conductor 12, the tapered end 90 and the recessed region 91 enter the conductor before the region 92. The tapered end 90 facilitates the initial entry of the connector 20 into the hollow conductor 12. The region 91 has a diameter that is the same as, or only slightly smaller than, the inside diameter of the hollow conductor 12 so that the crests of the threads in this region 91 slide on the inside wall of the hollow conductor 12. Because the diameter of this region 91 is smaller than the diameter of region 92, and all the threads are formed by the same threading tool, the crests of the threads in the region 91 have relatively flat surfaces, as can be seen in FIG. 3.

Because the region 91 of the connector 20 fits snugly within the hollow conductor 12, the connector is centered in coaxial alignment with the conductor 12 before the self-tapping threads in the region 91*a* and 92 begin to cut into the metal of the inside wall of the conductor. This ensures that the plane of the shoulder 25 is perpendicular to the axis of the conductor 12. The flat surfaces on the thread crests in the region 91 also help to center the connector coaxially within the conductor 12.

The two regions 91 and 92 are connected by a tapered region 91*a*, and it is in this region that the flat surface on the crests of the threads in region 91 transition to the sharp, pointed thread crests in the region 92.

To enable the shoulder 25 to fit snugly against the cut end of the inner conductor 12, the region 93 has the same reduced diameter as the region 91. A short tapered region 94 between the end of the most proximal threaded region 93 and the shoulder 25 flares the cut end of the inner conductor 12 slightly outwardly to ensure parallelism between the centerlines of the conductor 12 and the connector 20. In addition, the tapered region 94 ensures firm engagement between the end of the conductor 12 and the connector shoulder 25.

As the inner connector 20 is threaded into the hollow inner conductor 12, all four threads 81–84 cut into the inside wall of the conductor. The lead of the four threads 81–84 can be made considerably longer than the lead of a single-threaded connector. As a result, each complete revolution of the multiple-thread connector 20 relative to the conductor 12 advances the connector 20 farther into the conductor. Indeed, in most applications, a single revolution of the connector is sufficient to firmly attach the connector to the conductor, thereby shortening the installation time with corresponding reductions in installation costs. In a preferred embodiment, the lead of the threaded portion 31 is 0.160 inch, and the axial length of the region 92, including the two adjacent tapers, is 0.1055 inch.

As in most connector assemblies, the shapes and dimensions of the various parts are selected to provide impedance matching between adjoining parts, so that the complete connector and cable assembly has a low VSWR.

I claim:

1. A connector assembly for a coaxial cable having an outer conductor and a hollow inner conductor with an interior surface, said connector assembly comprising;

means for engaging the outer conductor of the cable;

an inner connector having a threaded portion adapted to fit into the hollow inner conductor in threaded engagement with the interior surface of the inner conductor, said threaded portion comprising a plurality of interleaved concentric threads; and a dielectric spacer between said engaging means and said inner connector.

2. The connector assembly of claim 1 wherein said plurality of threads are self-tapping.

3. The connector assembly of claim 1 wherein said threaded portion is generally cylindrical in shape.

4. The connector assembly of claim 1 wherein said threaded portion has a distal section and a proximal section, the distal section having a smaller diameter than the proximal section.

5. The connector assembly of claim 4 wherein the interior surface of said hollow inner conductor has an inside diameter, said distal section having a diameter equal to or slightly smaller than the inside diameter of said hollow inner conductor, said proximal section having a diameter slightly greater than the inside diameter of said hollow inner conductor.

6. The connector assembly of claim 1 wherein said threaded portion includes a tapered distal end to facilitate insertion into the hollow inner conductor.

7. The connector assembly of claim 1 wherein said plurality of threads are spaced symmetrically from each other around the axis of the inner connector.

8. The connector assembly of claim 1 wherein said plurality of threads includes four separate threads displaced 90 degrees from each other around the axis of said inner connector.

9. The connector assembly of claim 1 wherein a portion of each of said plurality of threads has a V-shaped cross-section.

10. The connector assembly of claim 1 wherein said threaded portion includes a proximal end and said inner connector includes an outwardly extending flange adjacent the proximal end of the threaded portion for engaging the inner conductor and thereby limiting movement of the inner connector into the inner conductor.

11. The connector assembly of claim 10 wherein said inner connector tapers inwardly from said flange to the proximal end of said threaded portion.

12. The connector assembly of claim 1 wherein said threaded portion has a proximal end, the proximal end of said threaded portion having a reduced diameter.

13. The connector assembly of claim 1 wherein said hollow inner conductor is made of a first material and said threaded portion of said inner connector is made of a second material, said second material having a greater hardness than said first material.

14. The connector assembly of claim 1 wherein a segment of at least one of said plurality of threads has a larger major thread diameter than the remaining segments thereof.

15. A method of attaching a connector assembly and a coaxial cable having a hollow inner conductor with an interior surface, said method comprising the steps of:

threading into the hollow inner conductor an inner connector having a threaded portion including a plurality of interleaved concentric threads, each of said plurality of threads being adapted to threadingly engage the interior surface of said hollow inner conductor; and attaching an electrically conductive component to the outer conductor of the coaxial cable.

16. The method of claim 15 wherein said plurality of threads are self-tapping.

17. The method of claim 15 wherein said threaded portion is cylindrical in shape.

18. The method of claim 15 wherein said threaded portion has a distal section and a proximal section, said distal section having a smaller diameter than the proximal section.

19. The method of claim 18 wherein said interior surface of said hollow inner conductor has an inside diameter, said distal section having a diameter equal to or slightly smaller than the inside diameter of said hollow inner conductor, said proximal section having a diameter slightly greater than the inside diameter of said hollow inner conductor.

20. The method of claim 15 wherein said threaded portion includes a tapered distal end to facilitate insertion into the hollow inner conductor.

21. The method of claim 15 wherein said plurality of threads are spaced symmetrically from each other with respect to the axis of the inner connector.

22. The method of claim 15 wherein said plurality of threads includes four separate threads displaced 90 degrees from each other around the axis of said inner connector.

23. The method of claim 15 wherein a portion of each of said plurality of threads has a V-shaped cross-section.

24. The method of claim 15 wherein said threaded portion includes a proximal end, said inner connector forms an outwardly extending flange adjacent said proximal end of the threaded portion for engaging the inner conductor and thereby limiting movement of the inner connector into the inner conductor.

* * * * *